US008769952B2

(12) United States Patent
Cogswell et al.

(10) Patent No.: US 8,769,952 B2
(45) Date of Patent: Jul. 8, 2014

(54) OIL RECOVERY FROM AN EVAPORATOR OF AN ORGANIC RANKINE CYCLE (ORC) SYSTEM

(75) Inventors: Frederick J. Cogswell, Glastonbury, CT (US); Ulf J. Jonsson, South Windsor, CT (US); Bruce P. Biederman, West Hartford, CT (US); Peter S. Matteson, South Windsor, CT (US); Michael D. Arner, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 723 days.

(21) Appl. No.: 12/670,764

(22) PCT Filed: Jul. 27, 2007

(86) PCT No.: PCT/US2007/016943

§ 371 (c)(1),
(2), (4) Date: Jan. 26, 2010

(87) PCT Pub. No.: WO2009/017473

PCT Pub. Date: Feb. 5, 2009

(65) Prior Publication Data

US 2010/0186410 A1 Jul. 29, 2010

(51) Int. Cl.
*F01K 25/00* (2006.01)

(52) U.S. Cl.
USPC ..... 60/671

(58) Field of Classification Search
USPC ..... 60/645, 649, 597, 671, 676, 677; 62/470, 471, 472, 513, 192, 510, 230, 62/228; 184/611, 612
See application file for complete search history.

(56) References Cited

U.S. PATENT DOCUMENTS

| | | | | |
|---|---|---|---|---|
| 5,182,919 | A | 2/1993 | Fujiwara | |
| 6,672,102 | B1 * | 1/2004 | Huenniger et al. | 62/472 |
| 6,880,344 | B2 | 4/2005 | Radcliff et al. | |
| 6,962,051 | B2 | 11/2005 | Radcliff | |
| 6,986,251 | B2 | 1/2006 | Radcliff et al. | |
| 6,989,989 | B2 | 1/2006 | Brasz et al. | |

(Continued)

FOREIGN PATENT DOCUMENTS

| | | |
|---|---|---|
| GB | 816507 | 7/1959 |
| JP | 54-060634 A | 5/1979 |

(Continued)

OTHER PUBLICATIONS

English Machine Translations of JP 2004346843A.*

(Continued)

*Primary Examiner* — Kenneth Bomberg
*Assistant Examiner* — Shafiq Mian
(74) *Attorney, Agent, or Firm* — Kinney & Lange, P.A.

(57) ABSTRACT

A method and system for recovering oil is used in an organic rankine cycle (ORC) system to recover oil from an evaporator of the ORC system and return the oil to an oil sump. The ORC system includes an evaporator, a turbine, a condenser and a pump, and is configured to circulate a refrigerant through the ORC system. The oil recovery system includes a recovery line configured to remove a mixture of oil and refrigerant from the evaporator. The mixture of oil and refrigerant passes through a heat exchanger in order to vaporize liquid refrigerant in the mixture and produce a mixture of oil and vaporized refrigerant. A delivery line is configured to deliver the mixture of oil and vaporized refrigerant to the turbine, at which point the oil may be separated from the vaporized refrigerant and recycled back to the oil sump.

11 Claims, 4 Drawing Sheets

(56) References Cited

U.S. PATENT DOCUMENTS

| | | | | |
|---|---|---|---|---|
| 7,013,644 | B2 | 3/2006 | Radcliff et al. | |
| 7,038,329 | B1 | 5/2006 | Fredette et al. | |
| 7,043,912 | B1 | 5/2006 | Radcliff et al. | |
| 7,100,380 | B2 | 9/2006 | Brasz et al. | |
| 7,146,813 | B2 | 12/2006 | Brasz et al. | |
| 7,174,716 | B2 | 2/2007 | Brasz et al. | |
| 7,254,949 | B2 | 8/2007 | Brasz et al. | |
| 7,281,379 | B2 | 10/2007 | Brasz | |
| 7,289,325 | B2 | 10/2007 | Brasz et al. | |
| 7,290,393 | B2 | 11/2007 | Cogswell et al. | |
| 2004/0003608 | A1 | 1/2004 | Takeuchi et al. | |
| 2004/0237555 | A1* | 12/2004 | Andrews | 62/230 |
| 2006/0037302 | A1* | 2/2006 | Peters et al. | 60/39.08 |
| 2006/0112692 | A1* | 6/2006 | Sundel | 60/670 |
| 2006/0179842 | A1 | 8/2006 | Brasz et al. | |
| 2009/0000299 | A1* | 1/2009 | Ast et al. | 60/618 |

FOREIGN PATENT DOCUMENTS

| | | | | |
|---|---|---|---|---|
| JP | 54060634 | A | * | 5/1979 |
| JP | 58032908 | A | * | 2/1983 |
| JP | 59-115407 | A | | 7/1984 |
| JP | 59115407 | A | | 7/1984 |
| JP | 2-219960 | A | | 9/1990 |
| JP | 2219960 | A | | 9/1990 |
| JP | 2004346843 | A | * | 12/2004 |
| JP | 2006283675 | A | * | 10/2006 |
| WO | WO 2006/104490 | A1 | | 10/2006 |
| WO | WO 2007/073365 | A1 | | 6/2007 |

OTHER PUBLICATIONS

English Machine Translations of JP 58032908A.*

English Machine Translations of JP2006283675A.*

English Machine Translations of JP54060634A.*

Official Search Report and Written Opinion of the counterpart foreign Application No. PCT/US07/16943, filed Jul. 27, 2007.

Mar. 4, 2013 Office Action in related Chinese Application No. 200780100056.2 filed Jul. 27, 2007.

The Japanese Office Action translation dated Aug. 3, 2011 for Japanese Patent Application No. 2010-518154.

* cited by examiner

OIL RECOVERY FROM AN EVAPORATOR OF AN ORGANIC RANKINE CYCLE (ORC) SYSTEM

CROSS-REFERENCE TO RELATED APPLICATION(S)

This application claims the benefit of PCT Application No. PCT/US2007/016943 filed Jul. 27, 2007, entitled "OIL RECOVERY FROM AN EVAPORATOR OF AN ORGANIC RANKINE CYCLE (ORC) SYSTEM".

BACKGROUND

The present disclosure relates to an organic rankine cycle (ORC) system. More particularly, the present disclosure relates to an improved method and system for recovering oil from an evaporator of an ORC system.

Rankine cycle systems are commonly used for generating electrical power. The rankine cycle system includes an evaporator or a boiler for evaporation of a motive fluid, a turbine that receives the vapor from the evaporator to drive a generator, a condenser for condensing the vapor, and a pump or other means for recycling the condensed fluid to the evaporator. The motive fluid in rankine cycle systems is often water, and the turbine is thus driven by steam. An organic rankine cycle (ORC) system operates similarly to a traditional rankine cycle, except that an ORC system uses an organic fluid, instead of water, as the motive fluid.

Oil may be used for lubrication in the ORC system, particularly inside the turbine. For example, oil provides lubrication for the bearings of the turbine. During operation of the ORC system, the oil may migrate from the turbine to other areas of the system. The oil may travel, with the refrigerant, from the turbine to the condenser and then to the evaporator. In some cases, it may be difficult to recover the oil from the evaporator, which results in a decrease in an amount of oil available for operation of the turbine.

There is a need for a method and system for recovering the oil from the evaporator of the ORC system and delivering it back to the turbine.

SUMMARY

An oil recovery system is used in an organic rankine cycle (ORC) system to recover oil from an evaporator of the ORC system and return the oil to an oil sump so that the oil may be used in the turbine as needed. The oil recovery system includes a recovery line configured to remove a mixture of oil (liquid) and refrigerant (liquid and vapor) from the evaporator. The mixture of oil and refrigerant then flows through a heat exchanger in order to vaporize liquid refrigerant in the mixture and produce a mixture of oil and vaporized refrigerant. At this point the oil is separable from the vaporized refrigerant and recycled back to the oil sump.

DETAILED DESCRIPTION

An organic rankine cycle (ORC) system may be used to generate electrical power. Oil is used within the ORC system to provide lubrication for various pieces of equipment, particularly inside a turbine of the ORC system. As the ORC is operating, however, the oil may travel to other parts of the ORC system. Commonly the oil travels with the refrigerant from the condenser to the evaporator. If the oil is not recovered from the evaporator, there may not be enough oil in the oil sump to startup the turbine or continue operating the turbine. In that case, a technician may be required to physically add oil to the oil sump to enable a startup of the system. The excess oil is then manually removed from the ORC system once the turbine is in an operational mode. This disclosure focuses on a method and system for recovering the oil from the evaporator so that the oil sump has an adequate amount of oil, especially for startup.

Figure 1:
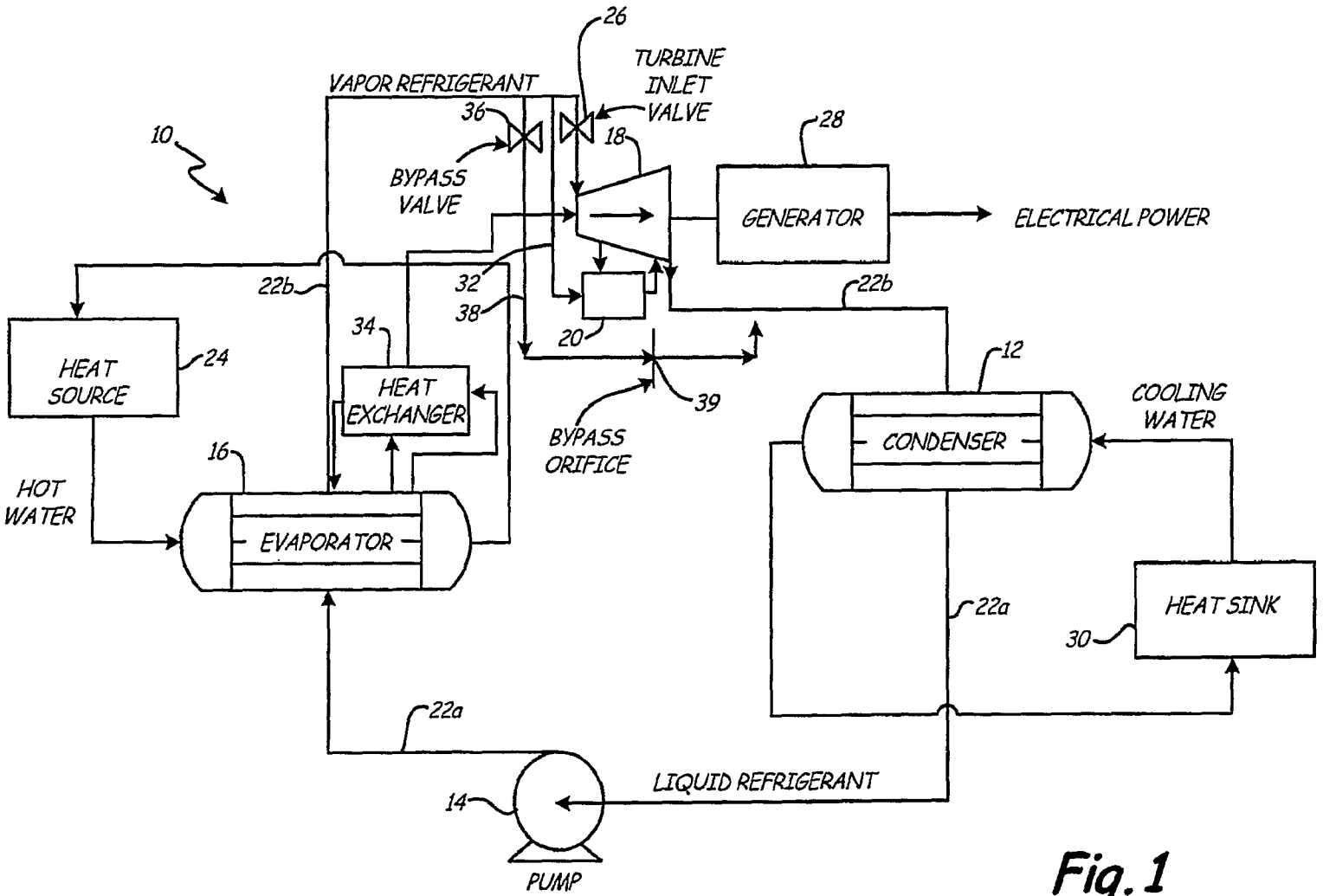
FIG. 1 is a schematic of an organic rankine cycle (ORC) system, including an evaporator and a turbine.

FIG. 1 is a schematic of ORC system 10, which includes condenser 12, pump 14, evaporator 16, turbine 18, and eductor system 20 connected to turbine 18. Refrigerant 22 circulates through system 10 and is used to generate electrical power. Liquid refrigerant 22*a* from condenser 12 passes through pump 14, resulting in an increase in pressure. High pressure liquid refrigerant 22*a* enters evaporator 16, which utilizes heat source 24 to vaporize refrigerant 22. Heat source 24 may include, but is not limited to, any type of waste heat, including fuel cells, microturbines, and reciprocating engines, and other types of heat sources such as solar, geothermal or waste gas. Refrigerant 22 exiting evaporator 16 is a vaporized refrigerant (22*b*), at which point it passes through turbine inlet valve 26 and into turbine 18. Vaporized refrigerant 22*b* is used to drive turbine 18, which in turn powers generator 28 such that generator 28 produces electrical power. Vaporized refrigerant 22*b* exiting turbine 18 is returned to condenser 12, where it is condensed back to liquid refrigerant 22*a*. Heat sink 30 is used to provide cooling water to condenser 12.

Eductor system 20 is connected to turbine 18 and is configured to remove oil from those areas of turbine 18 where it may commonly collect. As explained in more detail below in reference to FIG. 3, eductor line 32 receives a portion of vaporized refrigerant 22*b* flowing from evaporator 16 and delivers refrigerant 22*b* to eductor system 20.

Within system 10, oil is used primarily inside turbine 18. More specifically, the oil is commonly used for the gears and bearings of turbine 18 (see FIG. 3). During operation of system 10, however, some of the oil may leave turbine 18. In that case, the oil is typically carried by vaporized refrigerant 22*b* to condenser 12. The oil then combines with condensed refrigerant 22*a* exiting condenser 12 and travels with refrigerant 22*a* to evaporator 16. Depending on a design of evaporator 16, however, vaporized refrigerant 22*b* exiting evaporator 16 may not have enough velocity to transport the oil back to turbine 18. At some point, an oil level in an oil sump of turbine 18 may become too low. Heat exchanger 34 is connected to evaporator 16 and is configured to receive a mixture of oil (liquid) and refrigerant (liquid and vapor) from evaporator 16, and vaporize the liquid refrigerant. The mixture of oil and vaporized refrigerant then travels to turbine 18, at which point the oil and refrigerant are easily separated. The oil is then deliverable to the oil sump in turbine 18. This is described in more detail below in reference to FIGS. 2 and 3.

As shown in FIG. 1, ORC system 10 also includes bypass valve 36 and bypass line 38, which may be used to prevent refrigerant 22*b* from passing through turbine 18 during a startup. During a startup of system 10, turbine 18 temporarily runs in a bypass mode, at which time it does not receive any refrigerant, in order to reach the predetermined operating conditions (i.e. temperature and pressure) for turbine 18. In that case, refrigerant 22*b* flows through bypass line 38 and is directed through bypass orifice 39 to increase a temperature of refrigerant 22*b*, and imitate operating conditions inside turbine 18. After passing through bypass orifice 39, refrigerant 22*b* is directed to condenser 12. In some embodiments, bypass valve 36 is closed when turbine inlet valve 26 is open, and vice versa.

Figure 2:
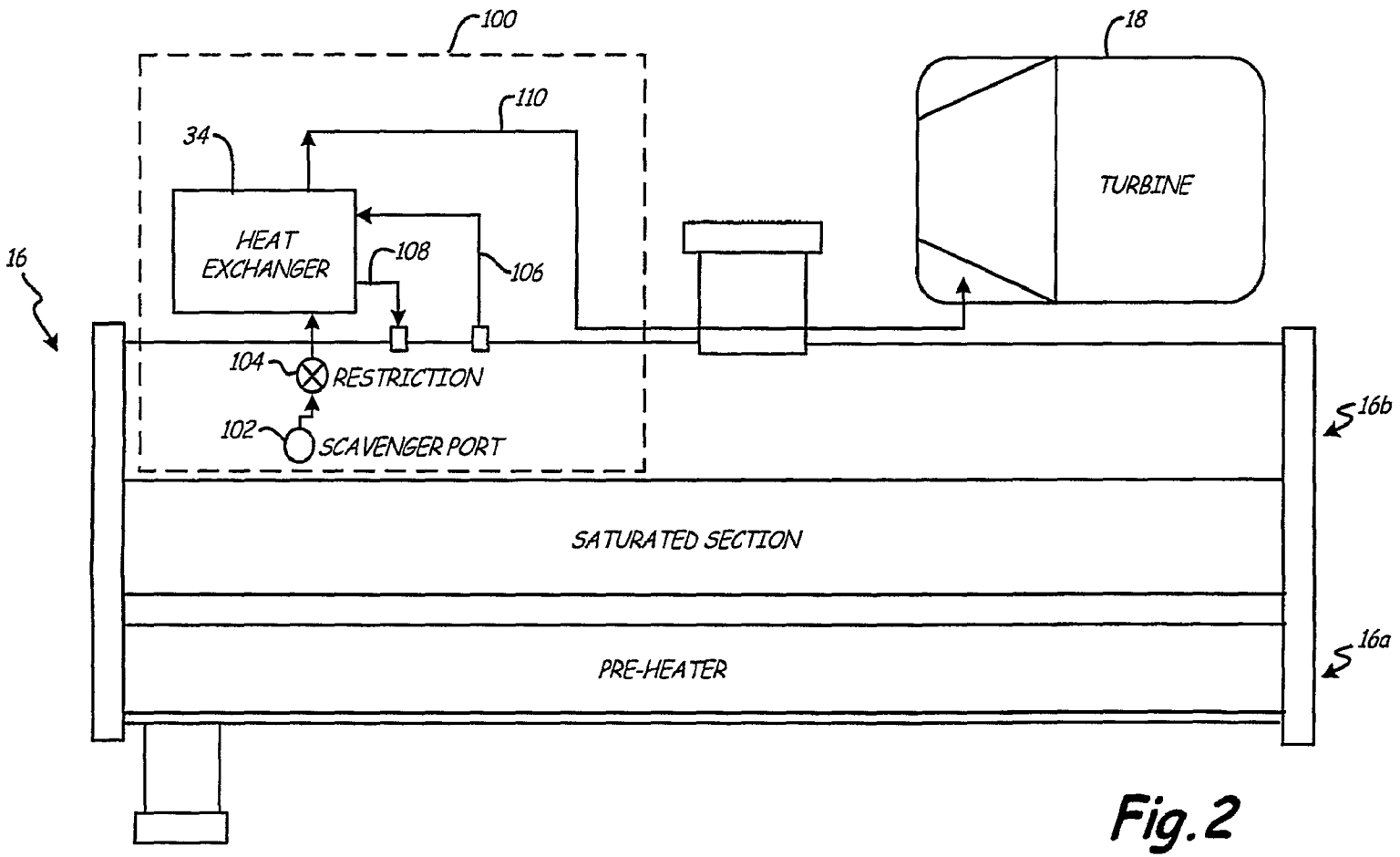
FIG. 2 is a schematic of the evaporator and the turbine from FIG. 1, as well as an oil recovery system for removing oil from the evaporator.

FIG. 2 is a schematic of a portion of ORC system 10 from FIG. 1, including evaporator 16, turbine 18, and heat exchanger 34, which is part of oil recovery system 100. As described above in reference to FIG. 1, evaporator 16 receives liquid refrigerant 22*a* and uses heat source 24 to vaporize refrigerant 22. In the exemplary embodiment shown in FIG. 2, evaporator 16 is a flooded evaporator, and includes a pre-heater section in bottom portion 16*a* and a saturated section in top portion 16*b*. Both the pre-heater section and the saturated section of evaporator 16 include a plurality of tubes, which are oriented horizontally inside evaporator 16. Refrigerant 22 flows over the tubes and is vaporized so that essentially all of refrigerant 22*b* traveling to turbine 18 is vaporized refrigerant. The liquid level of refrigerant inside evaporator 16 is maintained in order to keep the tubes wet during operation.

Oil recovery system 100 includes heat exchanger 34, scavenger port 102, restriction orifice 104, refrigerant inlet line 106, refrigerant outlet line 108, and delivery line 110. Scavenger port 102 and restriction orifice 104 form a recovery line to remove a mixture of oil and refrigerant from evaporator 16 and deliver it to heat exchanger 34. Scavenger port 102 is located on a side of evaporator 16 above a top of the tubes in top portion 16*b*. In a preferred embodiment, port 102 is located approximately one inch above the top of the tubes. During operation of evaporator 16, the level of liquid refrigerant in evaporator 16 which surrounds the tubes is normally maintained at a level near the location of scavenger port 102. The refrigerant in evaporator 16 is "pool boiling" over the tubes in the saturated section of evaporator 16. The resulting bubbles rise to the surface and a foam of refrigerant and oil forms. Oil inside evaporator 16 is concentrated at or near this surface.

The oil/refrigerant mixture is removed from evaporator 16 through scavenger port 102. The oil in the mixture is a liquid and the refrigerant is commonly in both a liquid and a vapor phase. The oil/refrigerant mixture then flows through restriction orifice 104 in order to restrict a flow of the fluid entering heat exchanger 34. The temperature and the pressure of the oil/refrigerant mixture decreases as it passes through orifice 104. Alternatively, orifice 104 may be substituted with an adjustable valve to control or restrict flow of the mixture to heat exchanger 34.

Heat exchanger 34 receives the oil/refrigerant mixture and uses saturated vapor refrigerant, also from evaporator 16, to heat the mixture. In an exemplary embodiment, heat exchanger 34 is a counter flow, flat plate heat exchanger. The saturated vapor refrigerant is removed from an uppermost part of evaporator 16, and is delivered to heat exchanger 34 through refrigerant inlet line 106. After passing through heat exchanger 34, the refrigerant is returned to evaporator 16 via refrigerant outlet line 108. Only a small percentage of saturated vapor refrigerant inside evaporator 16 is used by heat exchanger 34, and the refrigerant is recycled back to evaporator 16. Thus, using vaporized refrigerant to provide heating in heat exchanger 34 has little or no effect on operation and efficiency of evaporator 16.

Due to heat transfer from the saturated vapor refrigerant, the oil/refrigerant mixture is now comprised of an oil-rich liquid and vaporized refrigerant. As such, the oil is now easily separable from the refrigerant. The oil/refrigerant mixture exits heat exchanger 34 and is delivered to turbine 18 via delivery line 110.

Figure 2A:
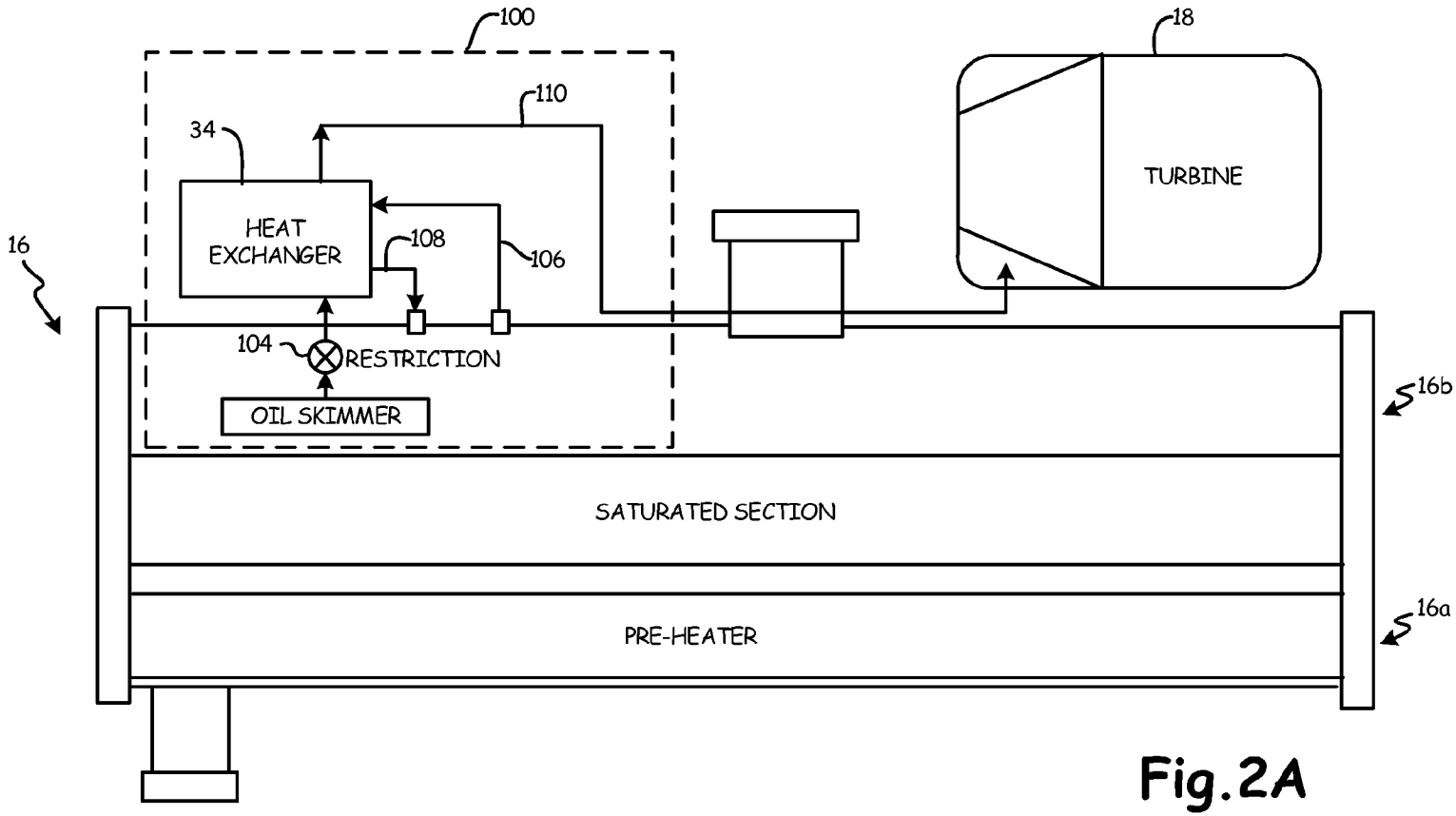
FIG. 2A is a schematic of another embodiment of the evaporator and the turbine from FIG. 1, as well as an oil recovery system for removing oil from the evaporator.

As shown in FIG. 2, scavenger port 102 is fixed to the side of evaporator 16. The location of port 102, as described above, is determined based on an operating level of liquid refrigerant inside evaporator 16. In an alternative embodiment, instead of scavenger port 102, an oil skimmer (shown in FIG. 2A), which floats inside evaporator 16, may be used to remove oil (and refrigerant) from the surface of the liquid refrigerant. Thus, the oil skimmer moves with the refrigerant level inside evaporator 16. A tube connected to the oil skimmer may be used to deliver the oil and refrigerant mixture from the oil skimmer to a port on a top or side of evaporator 16. The oil/refrigerant mixture is then delivered from evaporator 16 to restriction orifice 104.

Figure 3:
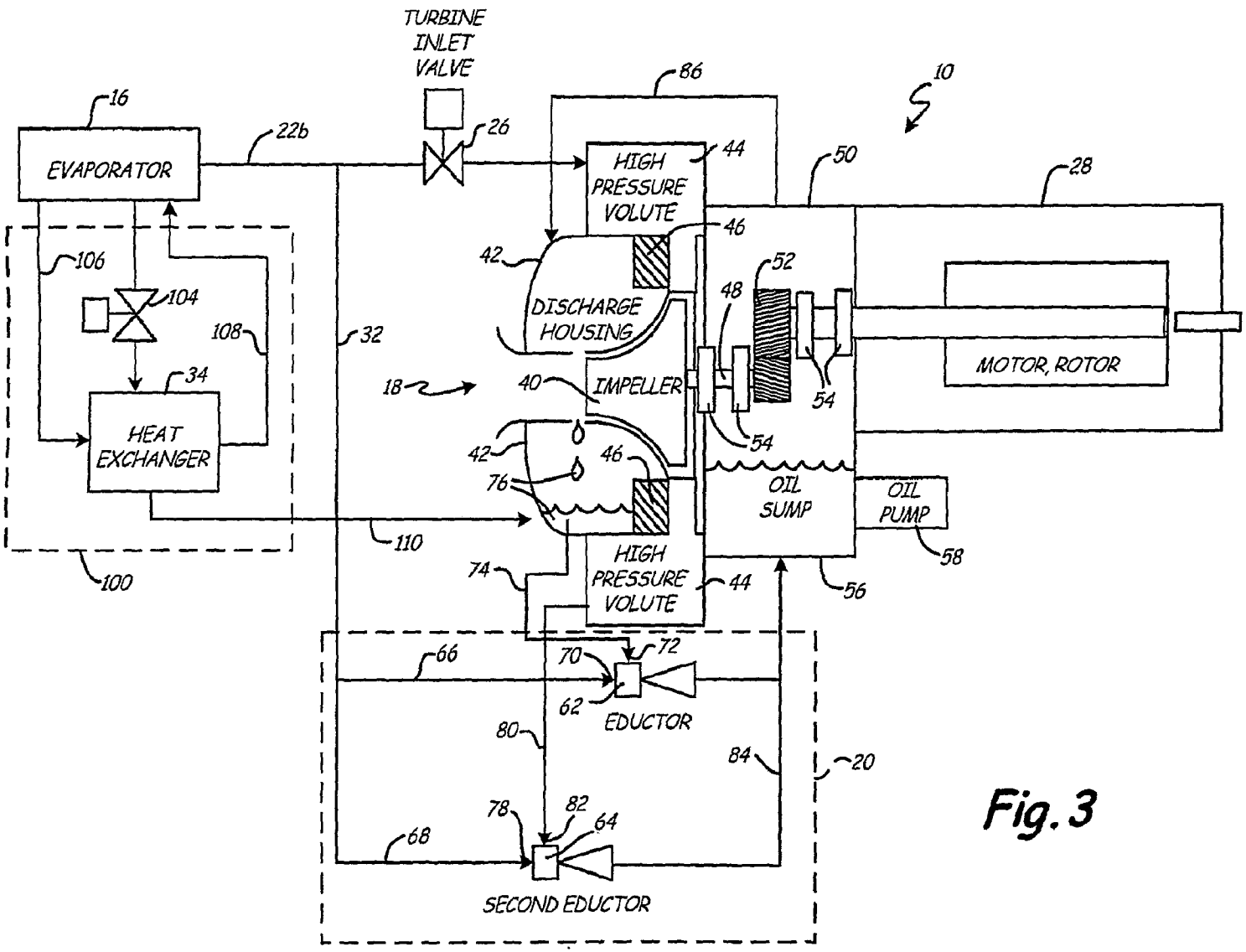
FIG. 3 is another schematic of the evaporator, the turbine, and the oil recovery system, as well as an eductor system for removing oil from the turbine and delivering it back to an oil sump.

FIG. 3 is a schematic of evaporator 16, turbine 18, and oil recovery system 100, all of FIG. 2, as well as eductor system 20 for removing oil from turbine 18 and delivering it to oil sump 56. Turbine 18 includes impeller 40, discharge housing 42, and high pressure volute 44. (Volute 44 is designated as "high pressure volute" since the volute is at high pressure when turbine 18 is operating. However, volute 44 is at low pressure when system 10 and turbine 18 are in the bypass mode during startup.) During an operational mode of turbine 18, vaporized refrigerant 22*b* (from evaporator 16) passes through inlet valve 26 into high pressure volute 44, and then through nozzles 46, which impart motive force to impeller 40 to drive shaft 48 inside gear box 50. Gears 52 connect drive shaft 48 to generator 28, which uses the shaft energy to generate electrical power. Gear box 50 also includes bearings 54, oil sump 56, and oil pump 58.

During operation of turbine 18, oil may commonly collect in discharge housing 42 and high pressure volute 44 of turbine 18. Eductor system 20 is used to remove oil from these areas of turbine 18 where oil is not needed, and in some cases may cause damage to the equipment. Eductor system 20 is configured to remove oil and return it to oil sump 56, making the oil available for other areas of turbine 18, such as, for example, gears 52 and bearings 54. Eductor line 32 is connected to eductor system 20 and is located upstream of turbine inlet valve 26. Line 32 is configured to receive a portion of vaporized refrigerant 22*b* exiting evaporator 16 (and flowing to turbine 18) and deliver it to eductor system 20.

Delivery line 110 delivers the mixture of oil (liquid) and refrigerant (vapor) from heat exchanger 34 to discharge housing 42 of turbine 18. Discharge housing 42 acts as a separator such that the liquid oil collects in a bottom of discharge housing 42 and the vaporized refrigerant exits turbine 18 through a vent, and then travels to condenser 12. The oil from evaporator 16 is combined with any oil 76 already inside discharge housing 42, all of which may be removed from discharge housing 42 using eductor system 20.

In the embodiment shown in FIG. 3, eductor system 20 includes first eductor 62 and second eductor 64, which operate as venturi devices, and each includes a primary flow inlet and a secondary flow inlet. In each eductor, high pressure refrigerant from evaporator 16 flows through the primary flow inlet, creating enough suction force to draw liquid out of turbine 18.

Eductor system 20 also includes first line 66 and second line 68, both of which are connected to eductor line 32. First line 66 is configured to deliver refrigerant 22 to primary flow inlet 70 of first eductor 62. Secondary flow inlet 72 of first eductor 62 is connected to line 74 and delivers oil 76 from discharge housing 42 of turbine 18 through first eductor 62. Oil 76 thus includes oil from evaporator 16 delivered through line 110. (It is recognized that although the liquid sucked out of discharge housing 42 is primarily oil, the liquid may contain some amount of refrigerant.) Second line 68 is configured to deliver refrigerant 22 to primary flow inlet 78 of second eductor 64. Line 80 is connected to secondary flow inlet 82 of second eductor 64 and delivers liquid removed from high pressure volute 44 of turbine 18. Liquid extracted from high pressure volute 44 is mostly oil; however, the liquid may include some of the refrigerant flowing inside turbine 18. After flowing through eductors 62 and 64, the refrigerant and the oil collectively travel to oil sump 56 through line 84. The refrigerant, which is vapor, may be recycled back to discharge housing 42 from sump 56 via line 86.

Although eductor system 20, as shown in FIG. 3, includes two eductors, it is recognized that eductor system 20 may operate with only first eductor 62. Oil may collect in both discharge housing 42 and high pressure volute 44. Second eductor 64 is able to remove oil from high pressure volute 44, where it commonly collects once the oil is separated from the vaporized refrigerant inside volute 44. Using a two-eductor system improves overall recovery of the oil because the oil may be removed from both areas around impeller 40 where it can accumulate.

In terms of recovering oil from evaporator 16, only first eductor 62 is required to effectively recover the oil to sump 56. Second eductor 64 is used to remove oil from high pressure volute 44 and, generally speaking, does not impact recovery of oil from evaporator 16. As explained above, however, second eductor 64 improves an overall recovery of oil that collects around impeller 40 of turbine 18. Thus, in one preferred embodiment, ORC system 10 uses a two-eductor system in combination with oil recovery system 100.

As stated above, discharge housing 42 of turbine 18 functions as a separator to separate the liquid oil and the vaporized refrigerant from heat exchanger 34. In an alternative embodiment, the oil/refrigerant mixture may be separated upstream of turbine 18 using a separator located along delivery line 110. The separator functions similarly to discharge housing 42. Thus, in some embodiments having a separator upstream of turbine 18, discharge housing 42 may be omitted from the turbine design. In that case, line 74 of eductor system 20 may be connected to the separator to remove the oil from the separator and deliver it through first eductor 62. Moreover, an additional line off of the separator may be included to deliver the vaporized refrigerant from the separator to condenser 12.

Using oil recovery system 100 and eductor system 20, ORC system 10 may be started up even when there is essentially no oil in oil sump 56. Oil recovery system 100 is able to effectively recover oil from evaporator 16 and deliver the oil to turbine 18, while system 10 is still in bypass mode, at which point eductor system 20 is used to deliver the oil back to oil sump 56. This may decrease or eliminate failed startups caused by not being able to supply oil to the gears and bearings inside the turbine. In some cases, if the oil sump was low, oil was manually added to the oil sump before startup. This added costs to operation of the ORC system and usually required that the added oil be removed from the ORC system, once the turbine was in an operational mode. ORC system 10 alleviates a need to manually add oil to sump 56 by providing a method of effectively recovering the oil from evaporator 16 and delivering it to sump 56.

Although the present invention has been described with reference to preferred embodiments, workers skilled in the art will recognize that changes may be made in form and detail without departing from the spirit and scope of the invention.

The invention claimed is:

1. An organic rankine cycle (ORC) system for generating power, the ORC system comprising:

a condenser configured to condense a vaporized refrigerant;

a pump configured to increase a pressure of the condensed refrigerant;

an evaporator configured to receive the condensed refrigerant and vaporize the refrigerant;

a turbine configured to receive the vaporized refrigerant and generate power;

an oil sump for storing oil used to operate the turbine;

a heat exchanger located downstream of the evaporator and configured to receive a mixture of oil and refrigerant from the evaporator, and vaporize liquid refrigerant in the mixture such that the oil is separable from the refrigerant and recoverable by the oil sump;

a separator configured to separate the oil and the vaporized refrigerant from the mixture, wherein the separator is a discharge housing of the turbine; and an eductor system for delivering oil from the separator to the oil sump.

2. The ORC system of claim 1 wherein a saturated vapor refrigerant from the evaporator passes through the heat exchanger to vaporize the refrigerant in the mixture of oil and refrigerant.

3. The ORC system of claim 1 wherein the ORC system further comprises a delivery line and the turbine comprises a vent, and wherein the delivery line delivers the mixture of oil and vaporized refrigerant to the discharge housing of the turbine, and wherein the discharge housing separates the oil and the vaporized refrigerant such that the oil collects in a bottom of the discharge housing and the vaporized refrigerant exits the turbine through the vent.

4. The ORC system of claim 1 wherein the eductor system comprises:

a first eductor configured to extract liquid from the separator; and an eductor line for delivering refrigerant to the first eductor to drive the first eductor.

5. A method of recovering oil in an organic rankine cycle (ORC) system having an evaporator, a turbine, an oil sump, and a condenser, the method comprising:

removing a mixture of oil and refrigerant from the evaporator;

increasing a temperature of the mixture using a heat exchanger such that liquid refrigerant in the mixture vaporizes;

separating the oil and the vaporized refrigerant after the mixture has exited the heat exchanger, wherein a discharge housing of the turbine separates the oil and vaporized refrigerant; and delivering the oil to the oil sump.

6. The method of claim 5 further comprising:

delivering the vaporized refrigerant to the condenser, after separating the oil and the vaporized refrigerant.

7. The method of claim 5 wherein delivering the oil to the oil sump comprises:

removing the oil from the discharge housing an eductor system.

8. The method of claim 5 further comprising:

restricting a flow of the mixture of oil and refrigerant using an orifice, prior to increasing a temperature of the mixture.

9. The method of claim 5 wherein the discharge housing separates the oil and the vaporized refrigerant such that the oil collects in a bottom of the discharge housing and the vaporized refrigerant exits the turbine through a vent in the turbine.

10. The method of claim 5 wherein removing the mixture of oil and refrigerant from the evaporator is performed by a scavenger port connected to the evaporator.

11. The method of claim 5 wherein removing the mixture of oil and refrigerant from the evaporator is performed by an oil skimmer inside the evaporator.

* * * * *

UNITED STATES PATENT AND TRADEMARK OFFICE

CERTIFICATE OF CORRECTION

PATENT NO. : 8,769,952 B2
APPLICATION NO. : 12/670764
DATED : July 8, 2014
INVENTOR(S) : Fredrick J. Cogswell et al.

It is certified that error appears in the above-identified patent and that said Letters Patent is hereby corrected as shown below:

In the Specification

Col. 4, Line 41
Delete "Gear box"
Insert --Gearbox--

In the Claims

Col. 7, Line 1, Claim 7
Insert --using-- after "housing"

Signed and Sealed this
Thirtieth Day of September, 2014

Michelle K. Lee

Michelle K. Lee
*Deputy Director of the United States Patent and Trademark Office*